US006682212B2

(12) United States Patent
Gao

(10) Patent No.: US 6,682,212 B2
(45) Date of Patent: Jan. 27, 2004

(54) LIGHT-EMITTING PEN WITH A LIGHT-EMITTING BODY AT A MIDDLE SECTION OF A PEN TUBE

(76) Inventor: Sheng-Siong Gao, 235 Chung-Ho Box 8-24, Taipei (TW)

( * ) Notice: Subject to any disclaimer, the term of this patent is extended or adjusted under 35 U.S.C. 154(b) by 0 days.

(21) Appl. No.: 10/038,476

(22) Filed: Jan. 7, 2002

(65) Prior Publication Data

US 2002/0141204 A1 Oct. 3, 2002

(30) Foreign Application Priority Data

Mar. 30, 2001 (TW) ..... 90204933 U
Nov. 9, 2001 (TW) ..... 90219357 U

(51) Int. Cl.[7] ..... B43K 29/10; F21V 5/00; G06G 1/02

(52) U.S. Cl. ..... 362/579; 362/118; 362/226; 362/800

(58) Field of Search ..... 362/118, 226, 362/800, 579; 401/195

(56) References Cited

U.S. PATENT DOCUMENTS 3,045,111 A * 7/1962 Hoenig ..... 362/579
3,122,328 A * 2/1964 Weber ..... 362/118
4,168,521 A * 9/1979 Bajusz ..... 362/118
5,131,775 A * 7/1992 Chen ..... 401/195
5,143,465 A * 9/1992 Hou ..... 401/195
5,275,497 A * 1/1994 Shiau ..... 401/195
5,405,208 A * 4/1995 Hsieh ..... 401/195
5,413,429 A * 5/1995 Shiau ..... 401/195
5,483,429 A * 1/1996 Chu ..... 362/118
5,544,967 A * 8/1996 Yao ..... 401/195
5,673,996 A * 10/1997 Ducker ..... 362/118
5,735,592 A * 4/1998 Shu ..... 362/118
6,158,871 A * 12/2000 Geddes et al. ..... 362/118
6,164,856 A * 12/2000 Lo ..... 401/52
6,238,057 B1 * 5/2001 Chen ..... 362/118
6,299,372 B1 * 10/2001 Wang ..... 401/195
6,439,734 B1 * 8/2002 Lo ..... 362/118

* cited by examiner

*Primary Examiner*—Stephen Husar
*Assistant Examiner*—Sharon Payne

(57) ABSTRACT

A light-emitting pen is formed by a front pen tube, a rear pen tube and a middle ring. A metal cap at a lower end of a resisting element in the rear pen tube is in contact with or not in contact with the metal button at a top end of the light-emitting element and a metal conductive wire at the same time. Then a light-emitting body emits light or does not emit light or a filler will move upwards or downwards. Moreover, the light-emitting body and the filler can be controlled in four different stages.

5 Claims, 10 Drawing Sheets

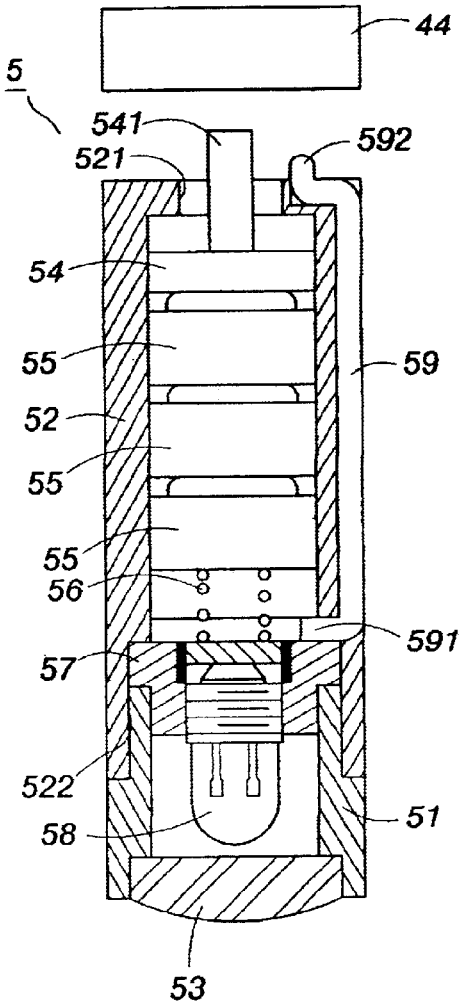
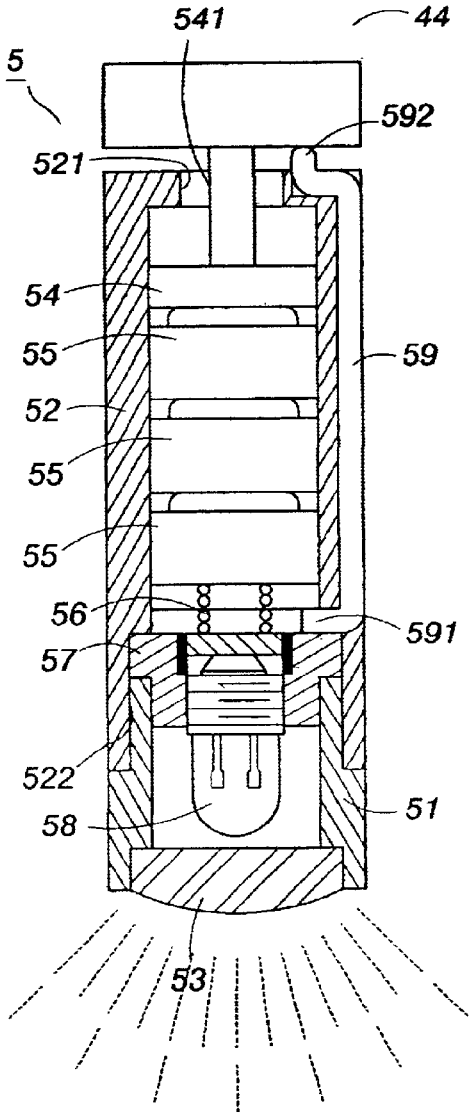
Fig.4
Fig.5

LIGHT-EMITTING PEN WITH A LIGHT-EMITTING BODY AT A MIDDLE SECTION OF A PEN TUBE

FIELD OF THE INVENTION

The present invention relates to light-emitting pens, and particularly to a light-emitting pen with a light-emitting body at a middle section of a pen tube, as the front pen tube is removed, rear pen tube becomes a luminous tool.

DESCRIPTION OF RELATED ART

In the prior art, light-emitting pens may be classified as a button pressing type, a rotary type, and a pushing button type. The button pressing type light-emitting pen has a button at one lateral side of the pen. The light-emitting pen lights up or does not light up by pressing the light-emitting pen, but the lifting and descending of the filler of the light-emitting pen can not be controlled. The rotary type light-emitting pen lights up or does not light up by rotating a front pen tube clockwise or counterclockwise, and meanwhile, the lifting or descending of the filler can be controlled. The pressing type light-emitting pen has a button at a distal end of the pen. The pen lights up or does not light up by pressing the button at the distal end of the light-emitting pen, and meanwhile, the lifting or descending of the filler can be controlled. The rotary type or pressing type light-emitting pen has two stages in controlling the lighting up of the light-emitting pen. Namely, to rotate (or press) the pen tube (or a button), the light-emitting pen will light up, while a further action will cause the light-emitting pen not to emit light. However, as the filler protrudes out, the light-emitting body must light up, but this feature has no use in daytime and just wastes power.

SUMMARY OF THE INVENTION

Accordingly, the primary object of the present invention is to provide a light-emitting pen having a front pen tube and a rear pen tube. The front pen tube has a spring and a filler, and the rear pen tube has a light-emitting element and a resisting element. An upper end of the filler has a light-emitting element; and the resisting element is installed above the light-emitting element. The light-emitting element has a light collecting tube and a battery tube. A front end of the light collecting tube is installed with a light collecting piece or light dispersing piece. A metal button, a plurality of serial connecting batteries, a spring, a metal conductive seat and a light-emitting body are sequentially installed in the battery tube. A lateral wall of the battery tube has a metal conductive wire, and a lower end of the conductive wire is in contact with a conductive seat. An upper end thereof protrudes out to be above the battery tube. The resisting element has a push tube. A lower end of the push tube has a metal cap. The metal cap is in contact with a tenon on the metal button. When a user presses a button on a top end of the resisting element, the metal cap will be in contact with the tenon of the metal button and an upper end of the conductive wire so that the light-emitting body emits light. On the contrary, when the metal cap is not in contact with an upper end of the conductive wire; and when the metal cap is not in contact with an upper end of the conductive wire, the light-emitting body does not emit light.

The various objects and advantages of the present invention will be more readily understood from the following detailed description when read in conjunction with the appended drawing.

BRIEF DESCRIPTION OF THE DRAWINGS

FIG. 4 is a schematic view showing that the light-emitting pen of the present invention does not emit light.

FIG. 5 is a schematic view showing that the light-emitting pen of the present invention emits light.

DETAILED DESCRIPTION OF THE PREFERRED EMBODIMENTS

Figure 1:
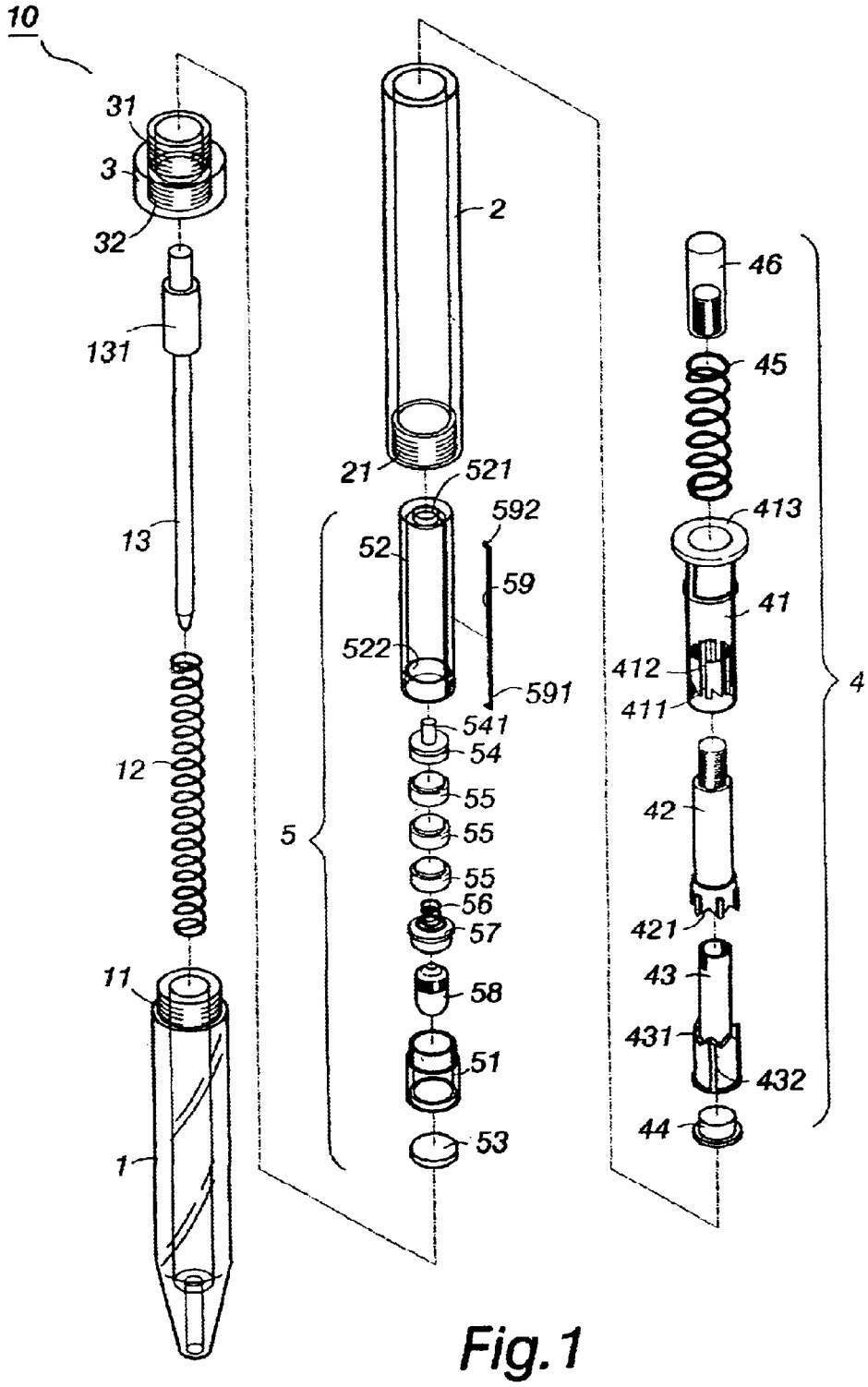
FIG. 1 is an exploded perspective view of the light-emitting pen of the present invention.
Figure 2:
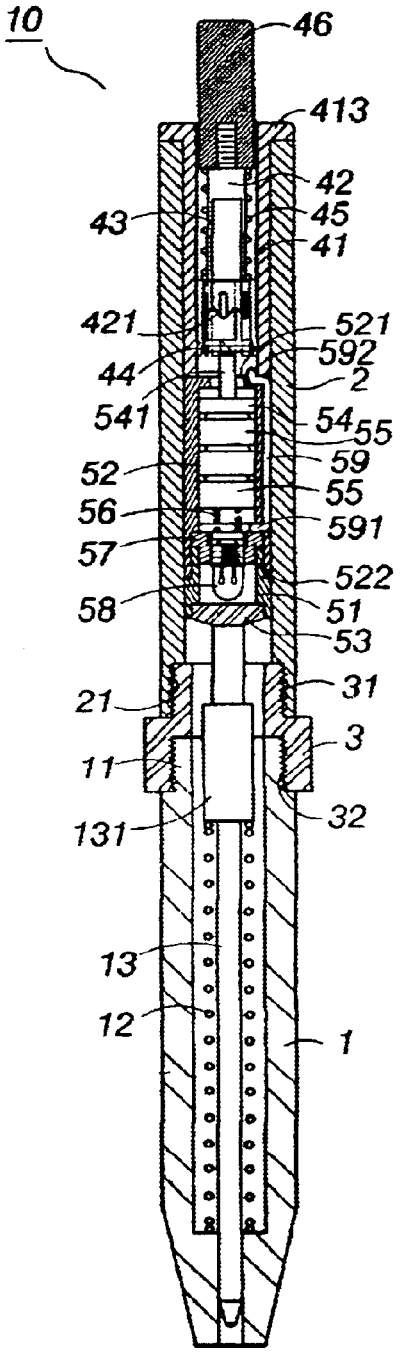
FIG. 2 is a cross sectional view of the light-emitting pen of the present invention.

An exploded perspective view of the light-emitting pen of the present invention is illustrated in FIG. 1. FIG. 2 is a whole cross sectional view of the light-emitting pen of the present invention which has been assembled. The light-emitting pen 10 of the present invention has a front pen tube 1 and a rear pen tube 2. A middle ring 3 is used to combine the two pen tubes. One end of the middle ring 3 has a threaded tube 31 which can be screwed into a threaded hole 21 at a lower end of the rear pen tube 2. Another and the middle ring 3 is a threaded groove 32 for being screwed by the threaded tube 31 at an upper end of the front pen tube 1. When the three components are combined, a main body of the pen is formed. It should be noted that preferably, the front pen tube 1 must be transparent and the rear pen tube 2 is a semi-transparent body. A spring 12 and a filler 13 are installed in the front pen tube 1. The upper end of the filler has a stopping post 131 with a larger diameter for resisting against the spring 11. A resisting element 4 and a light-emitting element 5 are installed in the rear pen tube 2. The resisting element 4 is positioned on the light-emitting element 5.

The resisting element 4 is a prior art structure and can be found in a generally used ball pen. The resisting element 4 is generally formed by a positioning tube 41, a middle tube 42 in the positioning tube 41, a push tube 43 in the middle tube 42, a metal cap 44 in the bottom of the push tube 43, a spring 45 above the middle tube 42, and a button 46 screwed at the upper end of the middle tube 42. After the positioning tube 41 is assembled with the rear pen tube 2, the stop ring 413 resists against the rear pen tube 2 so that as the button 46 is pressed by a finger, the middle tube 42 and the push tube 43 will descend. Moreover, by the spring 45, it will move upwards. By the ratchet teeth 411 of the positioning tube 41, the ratchet teeth 421 of the middle tube 42, and the ratchet teeth 431 of the push tube 43, in the process of lifting and descending, the push tube 43 will rotate through half tooth. Moreover, whether the push tube 43 protrudes out of the lower side of the middle tube 42 can be determined by determining whether the projecting track 432 is guided into the positioning tube 41 when the push tube 43 enters into the middle tube 42. If the projecting track 432 has entered into the guide track 412, then the whole push tube 43 will be embedded into the middle tube 42 as the push tube 43 moves up. On the contrary, if the push tube 43 does not enter into the guide track 412, then the lifted push tube 43 resists against the ratchet teeth 411 so that the push tube 43 protrudes out of the lower side of the middle tube 42.

The main body of the light-emitting element 5 is a light collecting tube 51 and a battery tube 52. The front end of the light collecting tube 51 is installed with a light collecting piece 53. A metal button, a plurality of serial connecting batteries 55, a spring 56, a metal conductive seat 57 and a light-emitting body 58 are sequentially installed in the battery tube 52. The upper end of the battery tube 52 has a through hole 521, and the lower end thereof has a hole 522 (or threaded hole). The through hole 521 serves for protruding the tenon 541 of the metal button 54. The hole 522 (or threaded hole) serves for engaging or screwing the conductive seat 57. The light-emitting body 58 fixed below the conductive seat 57 may be a light-emitting diode or a small light. A spring 56 is connected to the conductive seat 57. The spring resists against the negative end of a battery 55. The positive end of the battery 55 is in contact with the metal button 54. The outer wall of the battery tube 52 is embedded with a metal conductive wire 59. The lower end 591 of the conductive wire 59 is in contact with the conductive seat 57. The upper end 582 thereof protrudes from the upper side of the battery tube 52.

Figure 3:
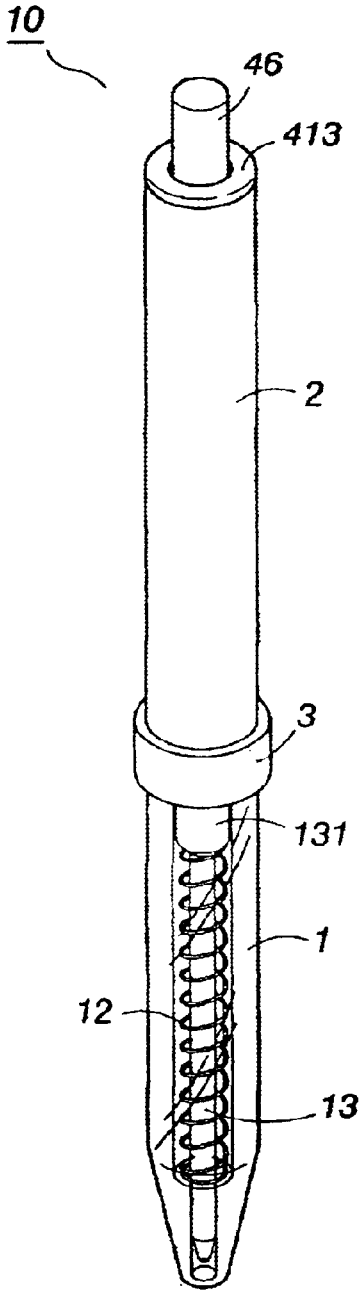
FIG. 3 is a perspective view of the light-emitting pen of the present invention.

Thereby, the top end of the filler 13 resists against the light collecting piece 53 of the light collecting tube 51. As the spring 12 restores, the filler 13 and the light-emitting element 5 are pushed to move upwards until the light-emitting element 5 resists against the resisting element 4. FIGS. 2 and 3 are assembled view of the present invention, wherein FIG. 3 shows an appearance of the present invention.

A whole cross sectional view of the light-emitting element of the present invention is illustrated in FIG. 4. It is illustrated that the light-emitting pen dose not emit light. At this time, the positive electrode of the battery 55 is in contact with the metal button 54 and thus the metal button 54 is positive. The lower end of the conductive wire 59 is in contact with the conductive seat 57. The conductive seat 57 is in contact with the spring 56. The spring 56 is in contact with the negative end of one battery 55 and thus the conductive wire 59 is negative. Before the metal cap 44 at the upper end does not descend, the tenon 541 of the metal button 54 and the upper end 592 of the conductive wire 59 protrudes out of the battery tube 52 are not in contact with the metal cap 44 and thus do not emit light.

FIG. 5 is a continuation of FIG. 4 and is a schematic view showing the light-emitting element emits light. It is illustrated that the metal cap 44 is pushed by the resisting element 4 and thus descends and contacts the metal button 54 and the upper end 592 of the conductive wire. After conduction, the light-emitting body 58 emits light. The light is transmitted through the light collecting piece 53 at the lower end thereof and then the light is collected. If the light collecting body 58 is a colored light-emitting body and then the light has various light based on the light-emitting body.

Figure 6:
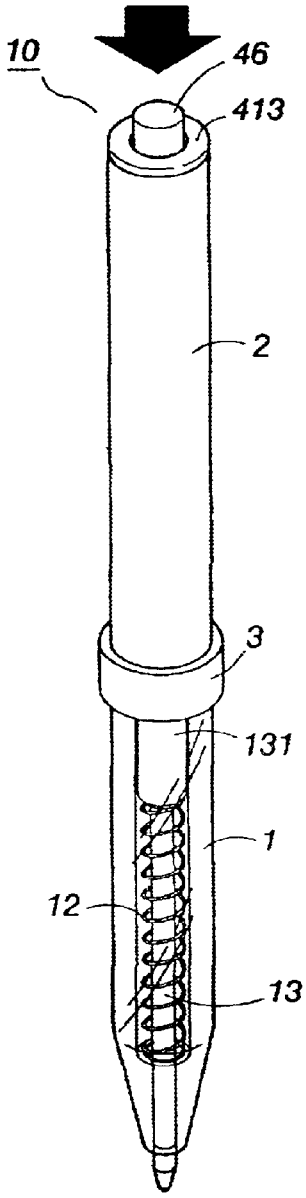
FIG. 6 is a perspective view showing that the light-emitting pen of the present invention lights up.
Figure 7:
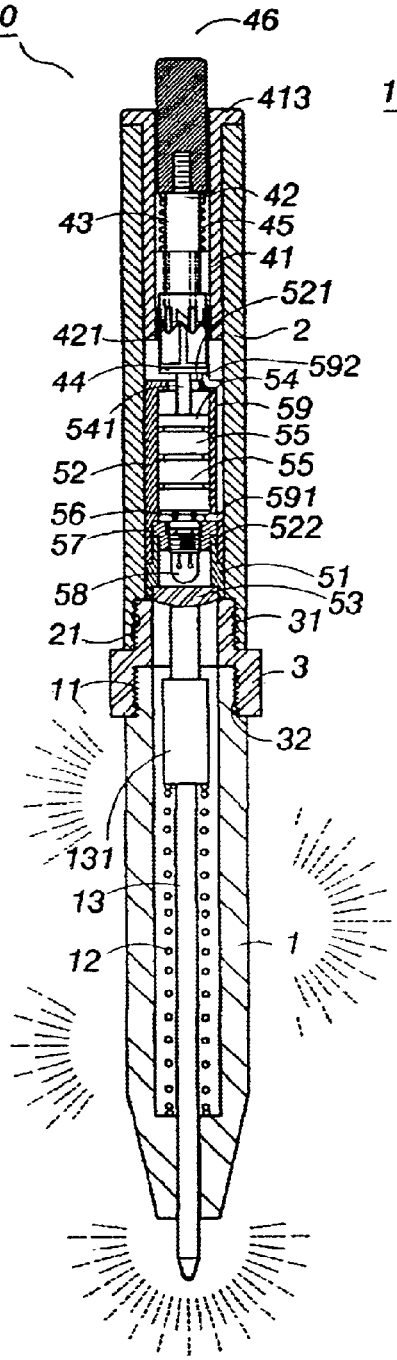
FIG. 7 is a cross sectional view showing that the light-emitting pen of the present invention lights up.

FIGS. 6 and 7 are perspective view and whole cross sectional view of the light-emitting pen of the present invention, wherein the light-emitting pen emits light. After the button 46 is pressed so that the push tube 43 descends, and thus the metal cap 44 is in contact with the metal button 54 and the upper end 592 of the conductive wire 59, then the light-emitting body 58 emits light.

Figure 8:
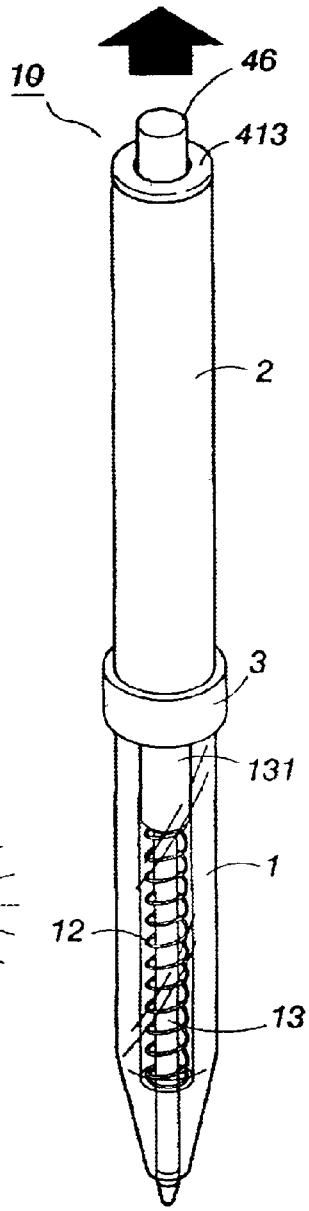
FIG. 8 is a perspective view showing that the light-emitting pen of the present invention dose not emit light.

On the contrary, when the user presses the button 46 again, the push tube 43 will move upwards, then the metal cap 44 is separated from the metal button 54 and the upper end 592 of the conductive wire. Thus, the light-emitting body 58 will not emit light, as illustrated in FIG. 8.

Figure 9:
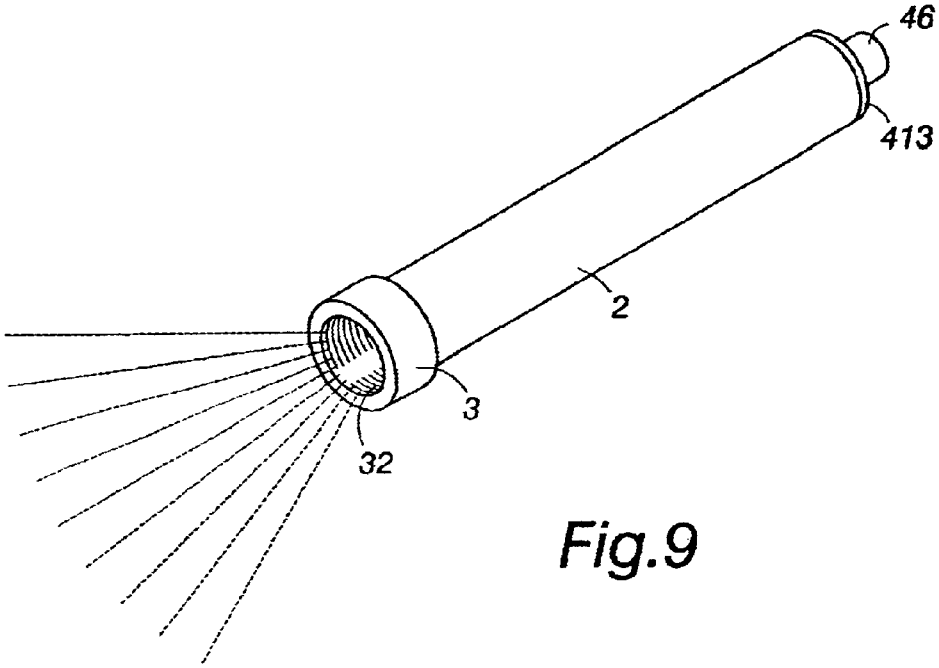
FIG. 9 is a perspective view showing that the light-emitting pen of the present invention is used as a luminous pen.
Figure 10:
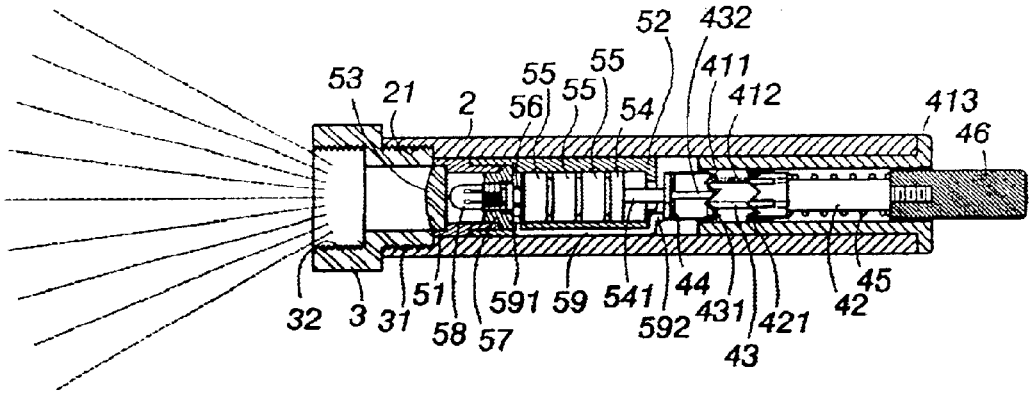
FIG. 10 is a cross sectional view showing that the light-emitting pen of the present invention is utilized as a luminous lamp.

FIG. 9 shows another schematic view of the present invention, wherein the front pen tube I of the light-emitting pen is detached from the middle ring 3 and only the rear pen tube 2 is left. When the user presses the button 46, the light-emitting element 3 (referring to FIG. 10) emits light. Then a small lamp is formed so that the light-emitting pen can be used at night.

Figure 11:
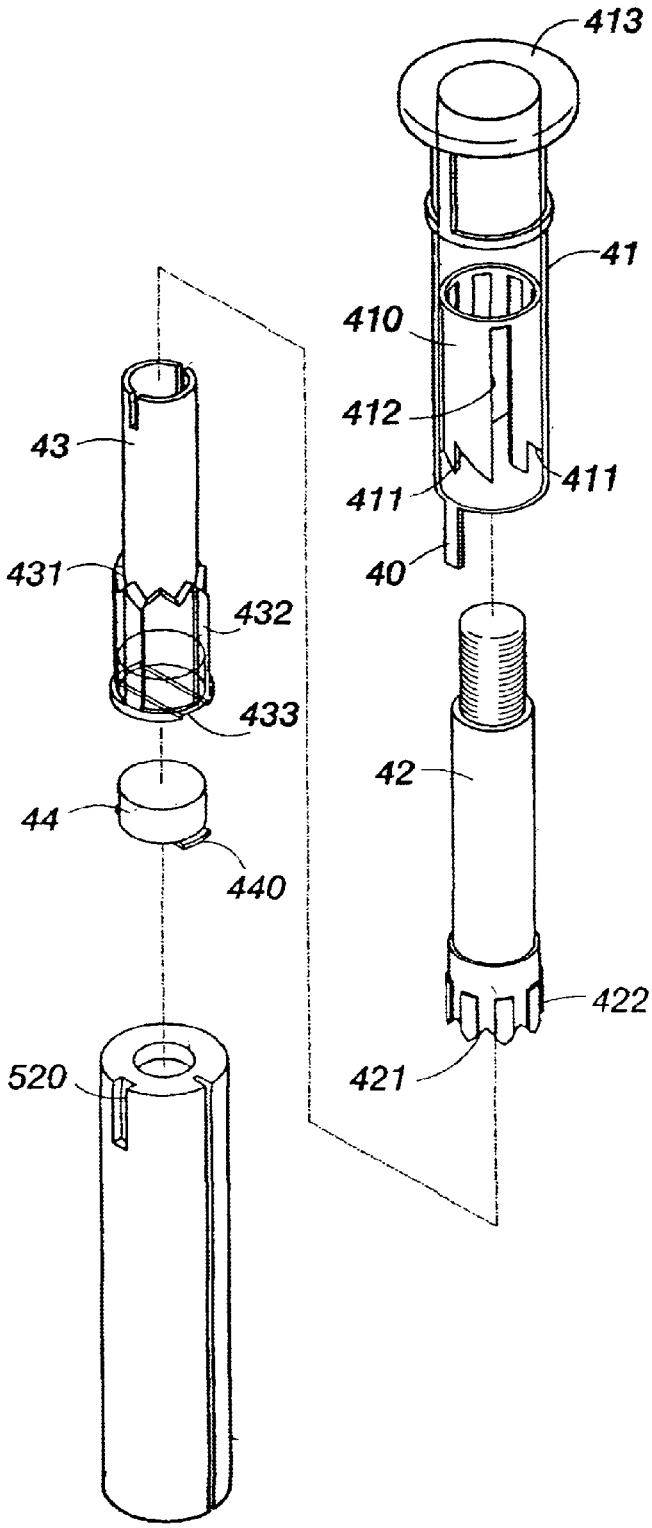
FIG. 11 is an exploded perspective view showing the positioning tube, middle tube and push tube of the light-emitting pen of the present invention, wherein the emission of light can be controlled in four different stages.

In above design, the light-emitting function and the filler are controlled through two stages. In the following a four-stage control way for controlling light-emitting function and the filler will be discussed. As shown in FIG. 11, an exploded perspective view of the present invention is illustrated. The lower end of a hollow push tube 43 is installed with two grooves which are symmetrical in left and right sides. The bottom of the metal cap 44 are installed with a long block 440. When the metal cap 44 is embedded into the bottom of the hollow push tube 43, the long block 440 will be embedded into the groove 433. Besides, the lower end of the guide body 410 is circularly installed with ratchet teeth 411 (eight teeth in one circle). A guide track 412 is installed every two guide track 412 (four guide tracks 412 in one circle). The lateral side of the ratchet teeth 421 (eight in one circle) at the lower end of the middle tube 42 is installed with guide strips 422. The middle section of the push tube 43 is circularly installed with ratchet teeth 431 (eight teeth in one circle)). A projecting track 432 is installed every two ratchet teeth 431 (totally, four projecting tracks in one circle). The operation is illustrated in FIGS. 12A to 12E. Moreover, the lower end of the positioning tube 41 is added with at least one positioning rod 40. An upper end of the battery tube 52 is installed with a positioning groove 520 which is conformed with the positioning rod 40, thereby, no rotation occurring between the battery tube 52 and the positioning tube 41.

Figures 12A, 12B, 12C, 12D, 12E:
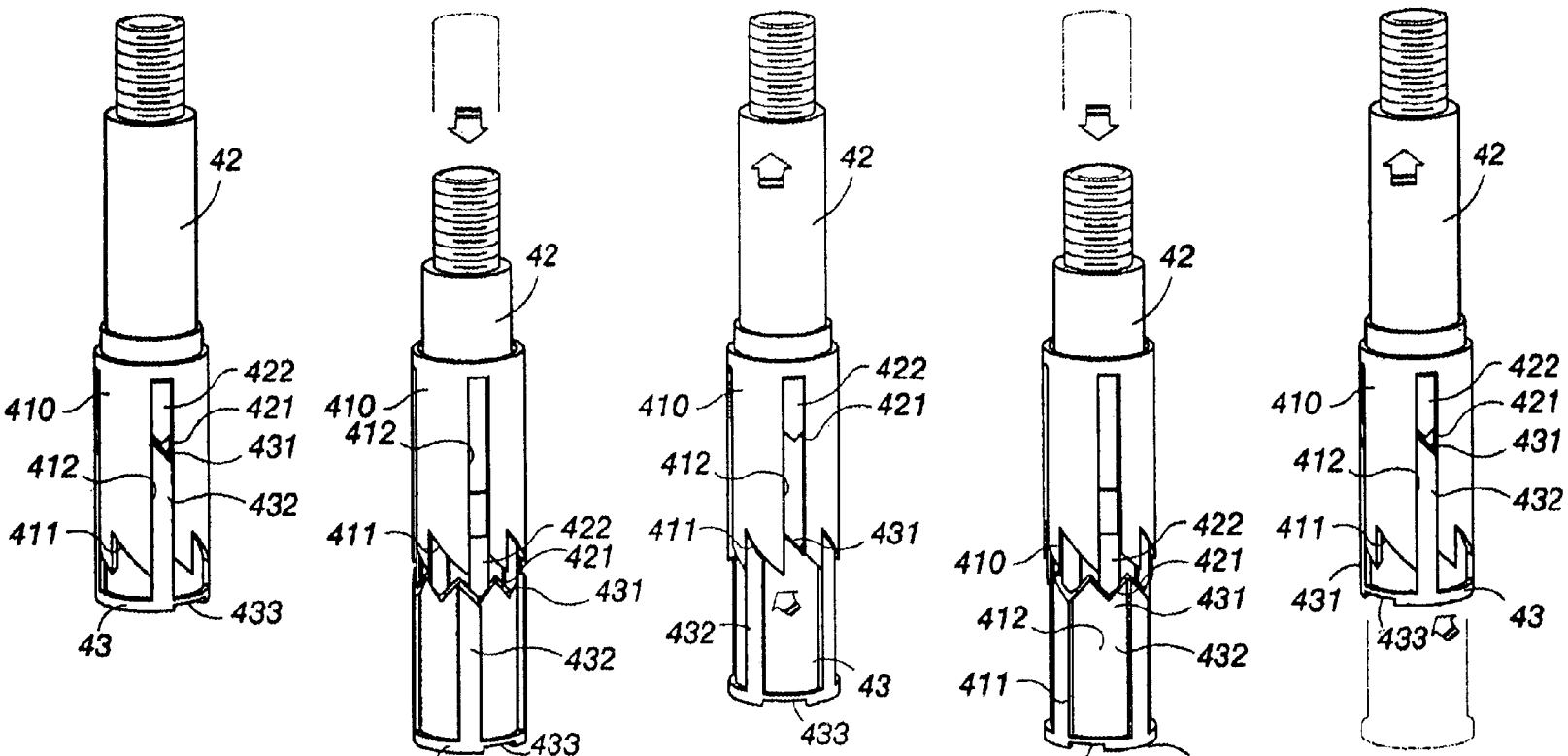
FIGS. 12A to 12E show the operation of the positioning tube, middle tube and push tube of the light-emitting pen of FIG. 11.
Figure 13A:
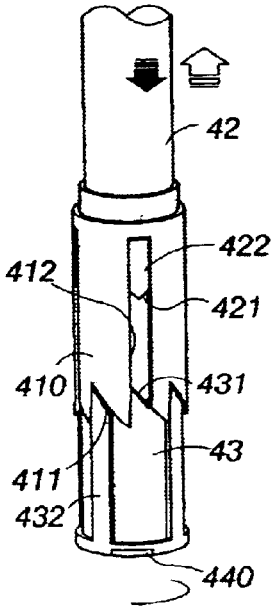
FIGS. 13A to 13D illustrate a perspective view showing that the middle tube and the push tube of the light-emitting pen are pressed firstly, a top view of the light-emitting element, a schematic view showing the contact of the resisting element and the light-emitting element and a perspective view of the front pen tube.
Figure 13B:
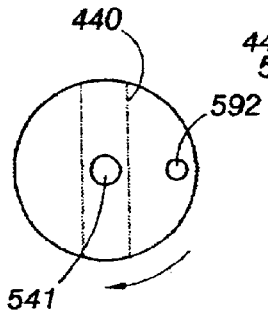
Figure 13C:
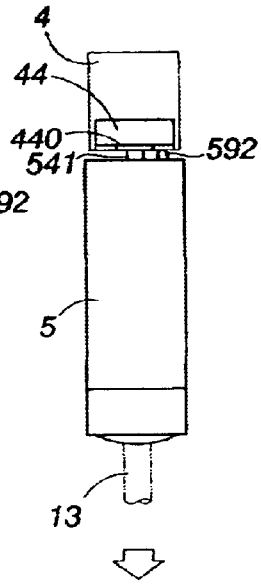
Figure 13D:
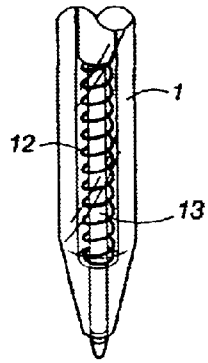
Figure 14A:
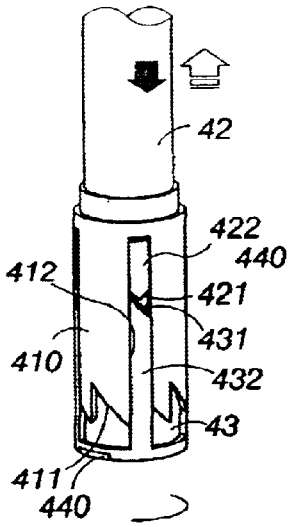
FIGS. 14A to 14D are schematic views showing that the button of above light-emitting pen is pressed again.
Figure 14B:
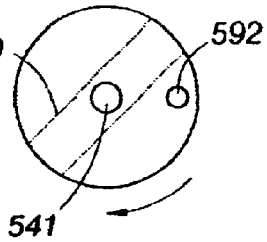
Figure 14C:
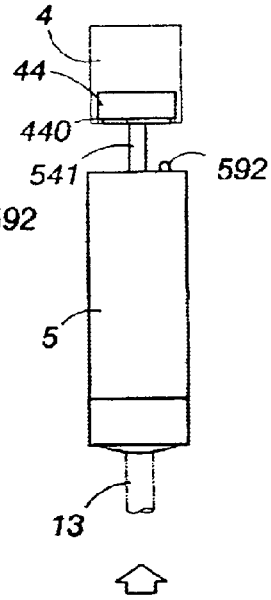
Figure 14D:
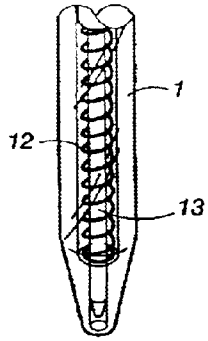
Figure 15A:
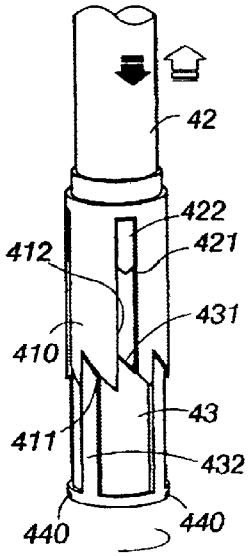
FIGS. 15A to 15D are schematic views showing that the button of above light-emitting pen is pressed thirdly.
Figure 15B:
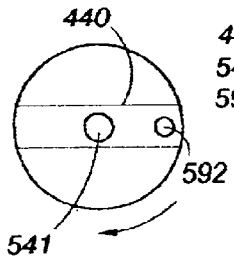
Figure 15C:
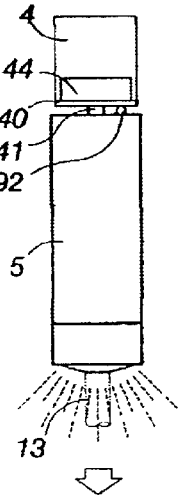
Figure 15D:
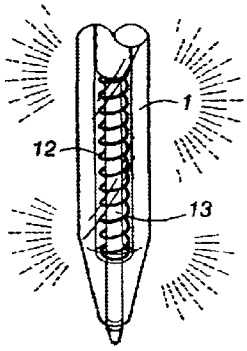
Figure 16A:
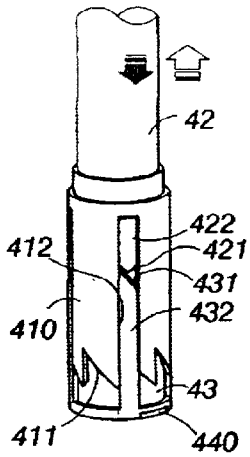
FIGS. 16A to 16D are schematic views showing that the button of above light-emitting pen is pressed fourthly.
Figure 16B:
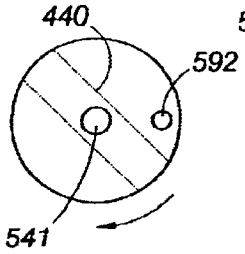
Figure 16C:
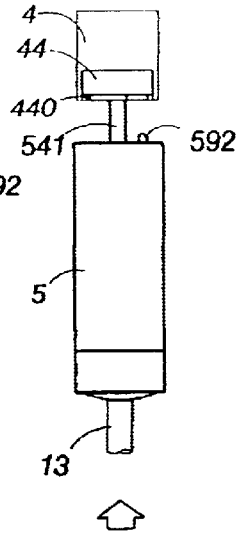
Figure 16D:
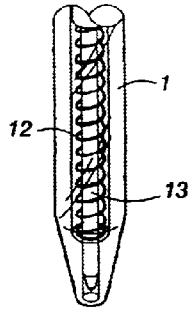

FIG. 12 A shows a middle tube 42 which is not pressed. The guide strips 422 and the protruding strips 432 are placed in the projecting track 412. When the middle tube 42 is pressed to resist against the push tube 43 and then it descends to separate from the guide body 410, the ratchet teeth 421 and the ratchet teeth 431 will cause the push tube 43 to rotate through an angle, as illustrated in FIG. 12B. When the middle tube 42 is not pressed, the middle tube 42 raises up. Then the push tube 43 can not move up since the ratchet teeth 431 and the projecting track 432 are shifted by the ratchet teeth 411, as shown in FIG. 12C. When the middle tube 42 is pressed again so that the push tube 43 descends to separate from the guide body 410, the ratchet teeth 421 and the ratchet teeth 431 will rotate through an angle, as shown in FIG. 12D. When the pressure applied on the middle tube 42 disappears, the middle tube 42 moves up again, then the projecting track 432 of the push tube 43 enters into the guide track 412 and then moves up, as shown in FIG. 12E. By this principle, the push tube 43 descends as a pressure applies thereon and then moves upwards as a further pressure applies thereon. At this time, the shifted angle of the push tube 43 is determined by the number of teeth in the ratchet teeth 411. If the number is eight, each lifting or descending action, the push tube 43 shifts an angle of 45 degrees (one eighth of one circle). By above principle and a conductive interval of 180 degrees, the light-emitting pen has the following four actions which performs sequentially.

Referring to FIGS. 13A to 13D, a perspective view showing that the middle tube 42 and the push tube 43 of the light-emitting pen are pressed firstly, a top view of the light-emitting element 5, a schematic view showing the contact of the resisting element 4 and the light-emitting element 5 and a perspective view of the front pen tube 1 are illustrated. When the user presses the button 46 of the resisting element 4, the middle tube 42 forces the middle tube 42 to descend, and when the pressure is released, the push tube 43 moves upward and is guided by the guide body 410 in the positioning tube 41 so that the push tube 43 shifts through an angle of 45 degrees when it moves upwards and is buckled in the ratchet teeth 411 of the guide body 410, thereby, causing the protruding front pen tube 1 of the filler 13 is in a written condition.

Referring to FIGS. 14A to 14D, schematic views showing that the button of above light-emitting pen is pressed again. Since a deeper projecting track 412 is formed every two ratchet teeth 411, when the user presses the button 46 again, the middle tube 42 descends to resist again the push tube 43. If the pressure is released, the push tube 43 move upwards, and then is guided by the guide body 410 so that the push tube 43 shifts through 45 degrees (a 90 degrees interval with the initial condition) and then is guided into the guide track 412, then the protruded filler 13 will enter into the front pen tube 1.

With reference to FIGS. 15A to 15D, schematic views showing that the button of above light-emitting pen is pressed thirdly. When the user presses the button 46 thirdly, the middle tube 42 forces the push tube 43 to descend, and as the pressure on the button is released, the push tube 43 moves upwards and is guided by the guided body 410 so that the push tube 43 shifts again as it moves upwards (with an interval of 135 degrees with the initial condition) and is then buckled to the ratchet teeth 411 so that the lower end of the filler 13 protrudes from the lower side of the front pen tube 1, thereby, causing the light-emitting pen is in a written condition. Meanwhile, the long block 440 at the lower end of the metal cap is in contact with the tenon 541 and the upper end 592 of the conductive wire, conducting the circuit of the light-emitting element 5 and causing the light-emitting element 5 to light up.

Referring to FIGS. 16A to 16D, schematic views showing the button of above light-emitting pen is pressed fourthly. When the user presses the button 46 fourthly, the middle tube 42 resists downwards against the push tube 43 so that the push tube 43 moves down. As the pressure on the button is released, the push tube 43 moves upwards and is guided by the guided body 410 so that the push tube 43 shifts through an angle of 45 degrees (has an interval of 180 degrees with the initial condition) as it moves upwards. Then it enters into the guide track 412. Then the protruding filler 13 will enter into the front pen tube 1, so that the light-emitting pen 10 is in a received condition. Meanwhile, the long block 440 at the lower end of the metal cap 44 is separated from the upper end 592 of the conductive wire, causing the circuit of the light-emitting element 5 to be interrupted and thus no light being emitted.

Figure 17:
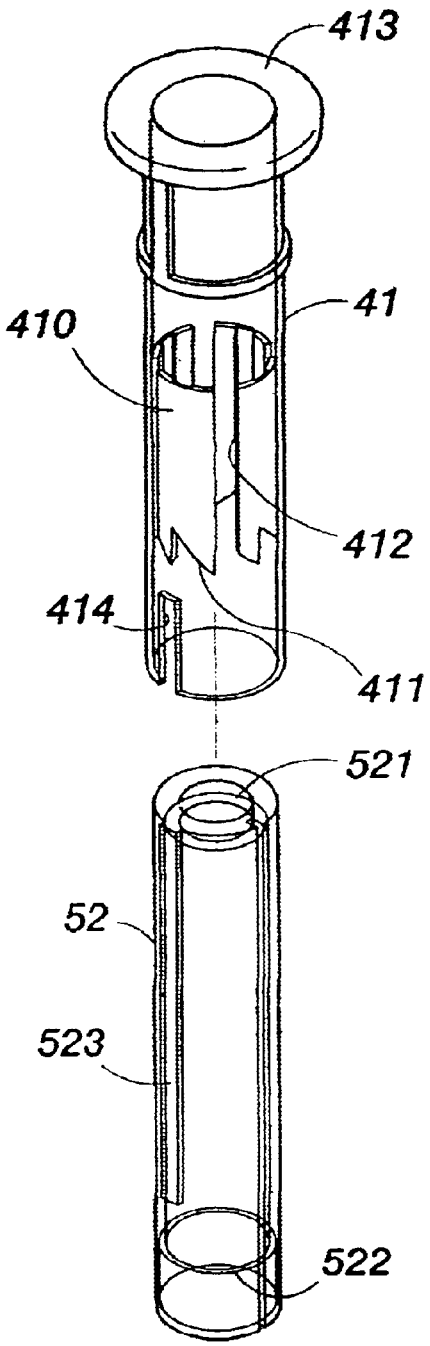
FIG. 17 is an exploded perspective view showing the battery tube and the positioning tube of the present invention which are matched with one another.
Figure 18:
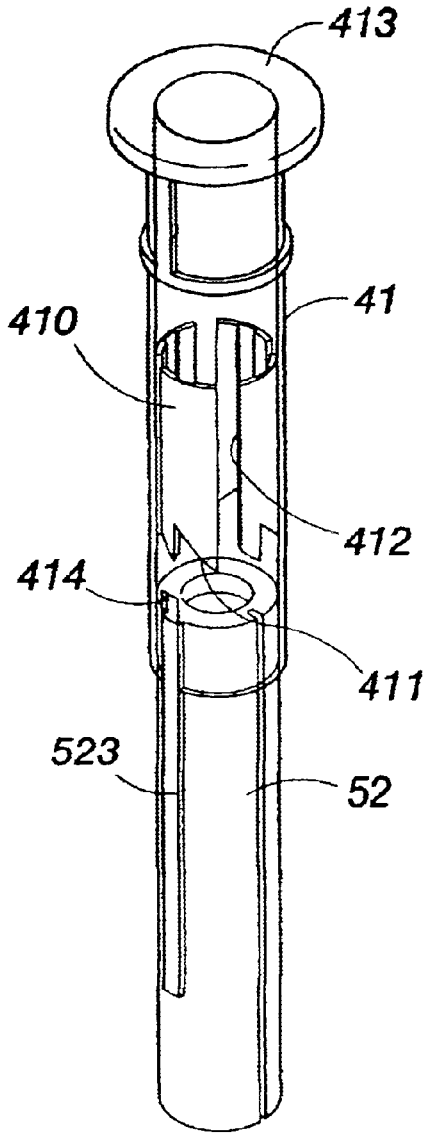
FIG. 18 is an assembled perspective view of the battery tube and positioning tube of FIG. 17.

In above FIG. 11, it is illustrated that the upper edge of the battery tube 52 is installed with a positioning groove which is conformed to the positioning rod 40 at the lower end of the positioning tube 41. Besides, another embodiment of the present invention is illustrated in FIG. 17, an outer edge of the battery tube 52 is added with a longitudinal tenon 523 to match the trench 414 at the lower end of the positioning tube 41, as shown in FIG. 18. Similarly, the battery tube 52 does not rotate with respect to the positioning tube 41.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A light-emitting pen having a front pen tube and a rear pen tube, the front pen tube having a spring and a filler, and the rear pen tube having the light-emitting element and a resisting element; an upper end of the filler having a light-emitting element; and the resisting element being installed above the light-emitting element; characterized in that:

the light-emitting element has a light collecting tube and a battery tube; a front end of the light collecting tube is installed with a light collecting piece or light dispersing piece; a metal button, a plurality of serial connecting batteries, a spring, a metal conductive seat and a light-emitting body are sequentially installed in the battery tube; a lateral wall of the battery tube has a metal conductive wire, a lower end of the conductive wire is in contact with a conductive seat, and an upper end of the conductive wire protrudes out to be above the battery tube; the resisting element has a push tube; a lower end of the push tube has a metal cap; the metal cap is in contact with a tenon on the metal button;

wherein when a user presses a button on a top end of the resisting element, the metal cap will be in contact with the tenon of the metal button and an upper end of the conductive wire so that the light-emitting body emits light; on the contrary, when the metal cap is not in contact with an upper end of the conductive wire; the light-emitting body does not emit light;

a lower end of the metal cap has a long block and a lower end of the hollow push tube has a groove; after the metal cap is embedded into the hollow push tube, the long block will be embedded into the groove.

2. The light-emitting pen as claimed in claim 1, wherein a middle ring is installed between the front pen tube and the rear pen ring, one end of the middle tube has a threaded tube which is screwed into a threaded hole in a lower end of the rear pen tube, and another end of the middle ring is a threaded groove for being inserted by a threaded tube at an upper end of the front pen tube; thereby, the front pen tube, rear pen tube and middle ring are combined.

3. The light-emitting pen as claimed in claim 1, wherein an upper end of the battery tube has a through hole, and a lower end of the battery tube has a hole groove or a threaded hole, the tenon of the metal button protrudes from the through hole; and the conductive seat is engaged with or screwed in the hole groove or threaded hole of the battery tube.

4. The light-emitting pen as claimed in claim 1, wherein a lower end of a positioning tube is installed with at least one positioning rod, and an upper end of the battery tube is installed with a positioning groove which is corresponding to the size of the positioning rod.

5. The light-emitting pen as claimed in claim 1, wherein a lower end of a positioning tube is installed with a trench, and an outer edge of the battery tube is installed with a longitudinal tenon corresponding to the trench.

* * * * *